US009956797B2

(12) United States Patent
Holtman et al.

(10) Patent No.: US 9,956,797 B2
(45) Date of Patent: May 1, 2018

(54) WEB FEEDING OF WEAK MEDIA

(71) Applicant: Océ Holding B.V., Venlo (NL)

(72) Inventors: Lodewijk T. Holtman, Venlo (NL); Wilhelmus J. E. G. Verhofstad, Venlo (NL)

(73) Assignee: OCE HOLDING B.V., Venlo (NL)

( * ) Notice: Subject to any disclaimer, the term of this patent is extended or adjusted under 35 U.S.C. 154(b) by 0 days. days.

(21) Appl. No.: 15/434,870

(22) Filed: Feb. 16, 2017

(65) Prior Publication Data

US 2017/0253059 A1 Sep. 7, 2017

(30) Foreign Application Priority Data

Mar. 2, 2016 (EP) ..... 16158187

(51) Int. Cl.
*B41J 15/04* (2006.01)

(52) U.S. Cl.
CPC ..... *B41J 15/04* (2013.01)

(58) Field of Classification Search
CPC ..... B41J 11/007; B41J 3/4075; B41J 11/006; B41J 11/0065; B41J 13/0054; B41J 13/103; B41J 13/106; B41J 13/12; B41J 13/18; B41J 13/223; B41J 13/226; B41J 13/24; B41J 13/32
See application file for complete search history.

(56) References Cited

U.S. PATENT DOCUMENTS

| | | | |
|---|---|---|---|
| 5,863,381 | A | 1/1999 | Magota et al. |
| 2004/0140044 | A1 | 7/2004 | Rassi et al. |

FOREIGN PATENT DOCUMENTS

| | | | |
|---|---|---|---|
| EP | 0 727 375 | A1 | 8/1996 |
| EP | 1 658 986 | A2 | 5/2006 |
| JP | 5-97299 | A | 4/1993 |

*Primary Examiner* — Kristal Feggins
(74) *Attorney, Agent, or Firm* — Birch, Stewart, Kolasch & Birch, LLP

(57) ABSTRACT

A printing system comprises a first bearing support for a first media roll of a first print medium and a second bearing support for a second media roll of a second print medium. Said first and second bearing supports are spaced apart from one another. A first print transport path extends from the first bearing support from the first media roll to a main transport path of the printing system. A second print transport path extends from the second bearing support to the main transport path of the printing system. An attachment transport path extends between the first and the second bearing support. The attachment transport path allows both print media to be brought together and attached to one another. Thereby, a relatively stiffer medium may be attached as a leader section to a relatively weaker medium.

15 Claims, 9 Drawing Sheets

Fig. 1A
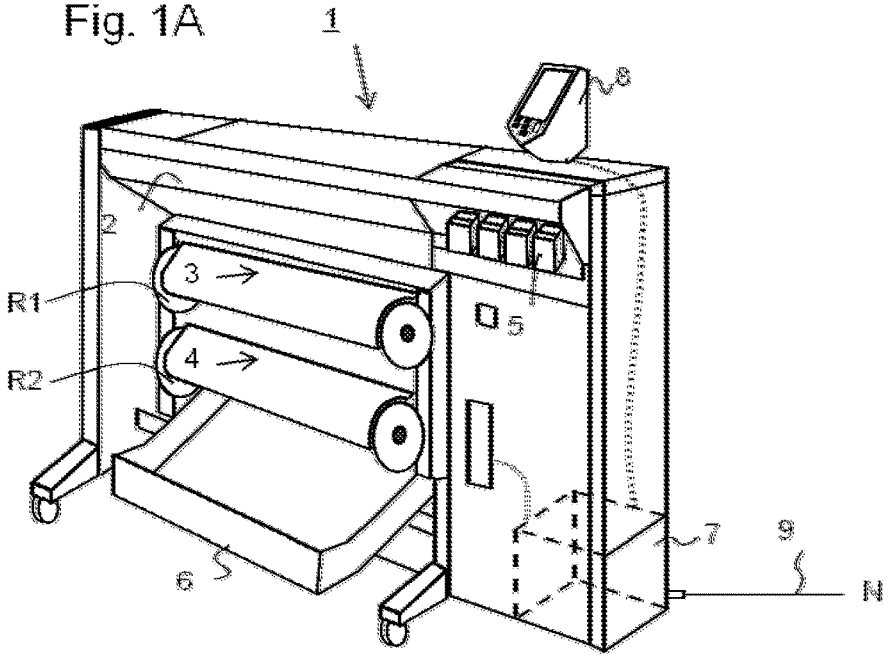
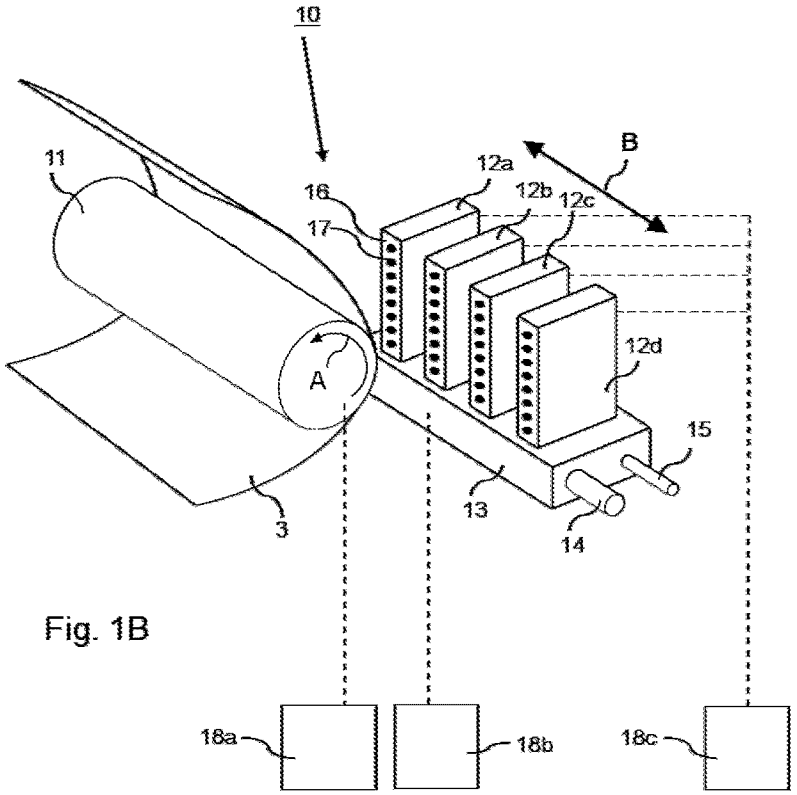
Fig. 1B

WEB FEEDING OF WEAK MEDIA

BACKGROUND OF THE INVENTION

1. Field of the Invention

The invention relates to a printing system and a method for feeding a web-based medium.

2. Description of Background Art

Web-based media are supplied into a printing system from media rolls in a loading bin of the printing system along a media transport path to an inkjet printing assembly for depositing an image on the media. The loading bin generally holds multiple media rolls for increased productivity and versatility. The media rolls may be of the same media type for forming a media supply or of different media types to accommodate different types of print jobs. After changing from a first media roll to a second media roll, the leading edge of the web from the second media roll needs to be guided through the printing system along the media transport path to e.g. a take-up roller arranged for winding the web onto it. This is referred to as "roll-to-roll" printing. Some media types however cannot be easily fed through the printing system. For example, certain media may be too weak or flexible to be pushed along the media transport path. These media types need first to be engaged by a pulling transport mechanism, such as the take-up roller or a transport pinch. Said mechanism is then able to pull these media types through the printing system. A drawback of these weak media is that an operator is required to guide said media manually through the media transport path to the pulling transport mechanism in a time-consuming process during which the actual printing is halted. This results in a decreased productivity and increased costs.

SUMMARY OF THE INVENTION

It is an object of the present invention to provide a low cost printing system capable of easily feeding weak media types through the printing system.

In accordance with the present invention, a printing system according to claim 1 and a method according to claim 11 are provided.

The printing system according to the present invention comprises:

- a first bearing support arranged for rotatably supporting a first media roll of a first print medium;
- a second bearing support arranged for rotatably supporting a second media roll of a second print medium, said first and second bearing supports being spaced apart from one another;
- a first print transport path extending from the first bearing support for transporting the first print medium from the first media roll to a main transport path of the printing system;
- a second print transport path extending from the second bearing support for transporting the second print medium from the second media roll to the main transport path of the printing system, wherein the first transport path bypasses the second transport path and the second media roll; and
- an attachment transport path extending between the first and the second bearing support and spaced apart from the first transport path.

In use, the first media roll holds the first medium and is supported on the first bearing supports, while the second bearing support rotatably holds the second media roll comprising the second medium. The first and second media may both be brought to the inkjet printing assembly positioned along the main transport path via their respective print transport paths. The printing system further comprises an attachment transport path which is arranged for bringing the first medium from the first media roll to the second media roll and/or vice versa. Basically, each media roll is provided with two media transport paths, one transport path extending to the inkjet printing assembly and another transport path extending to the other media roll. The attachment transport path allows both print media to be brought together and attached to one another.

The first medium may for example be a weak or thin medium unable to be pushed through the printing system, whereas the second medium is relatively stiff and able to be pushed through the printing system. The second medium is much easier to feed into the printing system, since it allows pushing. Said pushing may be applied manually or, preferably, by means of an automatic web feeding system. It is the insight of the inventors that a section of the second stiffer medium may be attached to the first weaker medium, whereafter said second medium section may be used to lead the first medium through the printer. The second medium may be used to provide a leader section of said stiffer medium for leading the weaker medium through the printing system. It is a further insight of the inventors that the leader section of the stiffer medium may be easily attached to the weaker medium by means of an attachment transport path between the media rolls. In an example of the present invention, the printing system according to the present invention may operate as follows. The first and second media are brought together along the attachment transport path and attached to one another, for example by taping the free ends of the media together. A predefined length of the second medium is then wound from the second media roll via the attachment transport path onto the first media roll. Said predefined length may for example correspond to a distance between the first media roll and the take-up roller (or another pulling transport mechanism) measured along a media transport path of the printing system. The cut-off section of the second stiffer medium is used as a leader device for guiding the first weaker medium to the take-up roller. Since the second medium is stiffer, it is easier to handle and may be pushed through the printing system. Since the first medium is attached to the second medium, the first medium follows the second medium through the printing system to the take-up roller. There the first weaker medium may be brought to and attached to the take-up roller, which then is able to pull the first medium through the printing system. The second stiffer medium may be of a relatively cheap media type, resulting in low costs and saving operator time. The second medium is also easier to handle, since it allows pushing. A printing system comprising the first and second bearing supports may be easily adapted to comprise an attachment transport path according to the present invention. Manual feeding by an operator is not required in the present invention, and the start-up time for a print job is reduced, resulting in increased productivity. Thereby the object of the present invention has been achieved.

More specific optional features of the invention are indicated in the dependent claims.

In an embodiment, the first transport path and the attachment transport path are positioned on opposite sides of one another with respect to a plane defined by the first and second bearing supports. As such, the attachment transport path may, for example, be positioned above the bearing supports while the first transport path extends below the bearing supports. The attachment transport is separated from the first transport path by the plane. Media may be fed to the main transport path from either the first or the second transport paths, but preferably not from the attachment transport path. The attachment transport path is preferably remote or isolated from the first, second, and/or main transport path. This achieves a space-efficient configuration. In another example, the main transport path extends vertically on one side of the bearing supports, e.g. along a side of the loading tray. The first and second transport paths then extend substantially below the plane to vertical main transport path. To ease access to the attachment transport path, the attachment transport path is provided above the bearing supports, preferably in between the bearing supports, when seen in a top down view.

It will be appreciated that in the above description the term weak or flexible refers to a medium unable to be pushed along a transport path without buckling or wrinkling of the medium. A stiff or strong medium herein is defined as a medium suitable for pushing transport, either manually or by means of an automatic web feeding system. The properties of the media, such as stiffness, width, and/or thickness, as well as the configuration of the printing system determine the distinction between weak and strong media. A practical example is the printing of very thin media, which can be relatively expensive and unsuited for feeding by an automatic pushing transport mechanism. The present invention then allows a thicker and often inexpensive medium to be used as a leader device, allowing automatic feeding of the thin media. It will be appreciated that while a strong medium may be used as a leader device, the present invention further allows at least two weak media to be overlaid on one another to form a suitably stiff leader section.

In the printing system the first and second bearing supports are preferably arranged for holding regular media rolls. The media rolls are therefore interchangeable, such that the position of the relatively weak first medium is irrelevant as long as a second stronger medium may be supplied to the media roll of the first weaker medium via an attachment transport path. This allows for versatility and flexibility during printing, for example when media rolls are replaced or exchanged.

In an embodiment, the attachment transport path is arranged for transporting the first print medium from the first media roll to the second media roll, and for transporting the second print medium from the second media roll to the first media roll. The attachment transport path is arranged for transferring the first print medium from the first media roll onto the second media roll and vice versa. A length of a medium unwound from one media roll may be wound onto the second media roll. A section of this length may be used for forming a leader section. Preferably said length corresponds to a transport path length required for automatic web feeding of the medium. This allows for a very compact construction, wherein the required length of the leader section may be much larger than the distance between media rolls, which is generally less than a meter.

In another embodiment, the first and the second print transport paths each connect to the main transport path at a transport path intersection spaced apart from the attachment transport path. The print transport paths bypass the attachment transport path and come together at or join the main transport path for bringing the media to the inkjet printing assembly. The first print transport path, second print transport path, and the attachment transport path preferably do not overlap. The first print transport path and the second print transport path are connected to one another at a common intersection at an end of the main transport path for transporting media from a respective media roll to the inkjet printing assembly positioned along the main transport path. Alternatively, the print transport paths each connect to the main transport path at different, spaced apart intersections. A further print transport path may be provided between the attachment transport path and the main transport path to bring media directly to the main transport path. This avoids reorienting a media roll with respect to the first or second print transport path after attaching the leader section.

In a further embodiment, the printing system according to present invention further comprises an attachment device positionable along the attachment transport path for attaching the first and second print media to one another. The attachment device is positioned between the media rolls, when viewed along the attachment transport path. This allows the first and second print medium to be brought from their respective media rolls to the attachment device, which may comprise an attachment surface for releasably or permanently attaching the print media together. The attachment surface may support the print media, specifically their free ends, during taping or gluing. The attachment surface may in a further embodiment define an attachment transport path section for transporting the first and second print media towards one another in opposite directions. Preferably, the attachment device comprises an adhesive applicator arranged for applying an adhesive, such as glue or tape, preferably along substantially the width of one of the first and second print media. Releasable attachments means such as magnets or clamps may also be applied. The attachment device allows for easy and rapid attachment of the print media to one another. In another embodiment which allows for a very compact construction of the printing system, the attachment device is positioned between the first and second bearing supports, when viewed in a direction perpendicular to a plane defined by the first and second bearing supports to form a compact construction.

In another embodiment, the printing system according to present invention further comprises a cutter positionable along the attachment transport path for cutting one of the first and second print media. The cutter is arranged for cutting the leader section of predefined length from one of the print media. The cutter is preferably moveable in a width direction of the print media, for example along a guide rail extending in said width direction. An actuator may be provided for moving the cutter. In a compact embodiment the attachment device comprises the cutter. A single actuator may then be applied for moving the adhesive applicator and the cutter.

In an even further embodiment, the printing system according to present invention further comprises a roll actuator arranged for rotating the first media roll supported on the first bearing support in a forward direction for transporting the first print medium of the first media roll along the attachment transport path to the second media roll, preferably to the attachment device, and in a reverse direction for winding the second print medium from the second medium roll supported on the second bearing support onto the first media roll. The first media roll is rotated in a first angular direction to bring the first print medium to the second print medium and/or to the attachment device. After attaching the print media to one another, the first media roll is rotated in a second angular direction reversed or opposite with respect to the first angular direction, such that a leading edge region of the first medium is returned to the first media roll via the attachment transport path. Since the second print medium is attached to the first medium, the second medium follows the leading edge region of the first medium onto the first medium roll. Thereby, the second print medium is wound or spooled onto the first media roll. Actuators for rotating the media rolls may be provided in the bearing supports. It will be appreciated that the first and second media and media rolls are interchangeable.

In another embodiment, the printing system according to the present invention further comprises a web feeding system for transporting at least one of the first and second print media from the respective one of the first and second media rolls to the inkjet printing assembly. Such a web feeding system may comprise a transport mechanism, such as one or more pinch rollers, positioned along the print transport paths and/or the main transport path for pushing a print medium to the inkjet printing assembly. The present invention is particularly advantageous when combined with an automatic web feeding system arranged for feeding, specifically pushing, the second stiffer medium from a respective media roll through the printing system. No operator effort is then required for feeding the media through the printing system.

In another embodiment, the printing system further comprises a controller for controlling the actuators for the media rolls, the web feeding system, the attachment device and/or the cutter. One or more sensors may be provided to detect the status and/or positions of the print media. The controller may apply this sensor data to operate the printing system automatically without operator interference.

In another embodiment, the printing system further comprises a loading tray wherein the first and second bearing supports are provided. The first transport path extends substantially along a bottom of the loading tray below the first and second bearing supports while the attachment transport path extends substantially above the first and second bearing supports. The main transport path is preferably extending vertically on one side of the loading tray. This achieves a compact tray capable of holding different media, which improves the productivity. To allow easy access to the attachment transport path, it is positioned above the bearing supports.

In a further aspect the present invention provides a method for feeding a web-based medium into a printing system, the method comprising the steps of:

- transporting a first print medium from a first print medium roll and a second print medium from a second medium roll to one another via an attachment transport path;
- attaching a leader section of a predefined length of the second print medium to the first print medium
- positioning the leader section attached to the second print medium with respect to one of a first and second transport path, which first and second transport paths are separate from the attachment transport path; and
- transporting the leader section attached to the first print medium via the one of the first and second transport path to an inkjet printing assembly of the printing system.

The first medium may be a relatively weak print medium unsuited for pushing transport through the printing system. The second print medium is preferably a stiffer, and preferably cheaper, medium compared to the first print medium. Due to its stiffness or thickness the second print medium is able to be pushed through the printing system without damage, such as tearing or wrinkling. The print media are brought together, either by moving one or both of the media preferably along the attachment transport path. Due to its stiffness, the leader section of the second print medium may with little effort be fed through the printing system, either manually or by an automatic web feeding system. The first print medium is pulled by the second print medium and follows the leader section of the second medium through the printing system, e.g. to a take-up roller. Using the second cheaper print medium allows for a cost effective method, which may be easily implemented in existing printing systems. Thereby the object of the present invention has been achieved.

In an embodiment, the method according to the present invention further comprises the step of winding the leader section of the second print medium from the second media roll onto the first media roll via the attachment transport path. Since the leader section may require considerable length, e.g. a transport path length from a media roll to take-up roller, spooling the second medium onto the first media roller allows the method to be implemented in the relative compact space of a loading bin or tray without increasing the overall dimensions of the printing system.

In a further embodiment, the step of transporting the print media comprises transporting the first print medium along an attachment transport path extending between the first media roll and an attachment position for attaching the first and second print media to one another, the step of transporting the print media further comprises transporting the second print medium along the attachment transport path, said attachment transport path further extending between the second media roll and the attachment position, and the method according to the present invention further comprises the step of transporting the leader section of the predefined length of the second medium from the second media roll along the attachment transport path to the first media roll. The attachment position is where the media are attached to one another and preferably corresponds to the position of the attachment device. By means of the attachment transport path the media rolls become interchangeable, i.e. the stiffer print medium may be provided on the first media roll while the weaker print medium sits on the second media roll, or vice versa. No adaption of the media rolls or the bearing supports is required, since regular or commonly used media rolls and media may be applied in the method according to the present invention.

In an even further embodiment, the step of attaching the first and second print media comprises attaching a leading edge region of the first print medium at or to a trailing edge region of the leader section of the second medium. By keeping the overlap between the print media minimal, consumption of the print media is reduced. Alternatively, the leader section of the second print medium may be provided on the first medium over the length of the leader section for simultaneously or synchronously transporting the leading edges of both print media through the printing system. It will be appreciated that, while the description refers to weak and strong media, the first and second medium may also both be weak media. For example, a first weak medium may be covered by a leader section of a second weak (or even identical) medium, such that the combined stiffness of the media forms a leader section of sufficient stiffness or strength to allow said leader section to be pushed through the printing system in the above described manner. As such, two or more layers of a weak medium may be used to form a suitably stiff leader section by the cumulated stiffness of weak media.

In an embodiment, the step of transporting the leader section comprises feeding the leader section attached to the first print medium along a transport path of the printing system by means of a web feeding system. Automated web feeding systems are generally arranged for pushing media along a transport path. By implementing the present invention, weaker media may also be automatically fed by an automatic web feeding system, increasing production time.

All types of print media may be applied for the leader section of the print medium, such as paper, textile, plastics, canvas, film etc. It is within the scope of the present invention to provide pre-cut leader section sheets on a media roll or other suitable holders.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 1A is a schematic perspective view of a printing system according to the present invention;

FIG. 1B is a schematic perspective view of an inkjet printing assembly of the printing system in FIG. 1A;

DETAILED DESCRIPTION OF THE PREFERRED EMBODIMENTS

Figure 2:
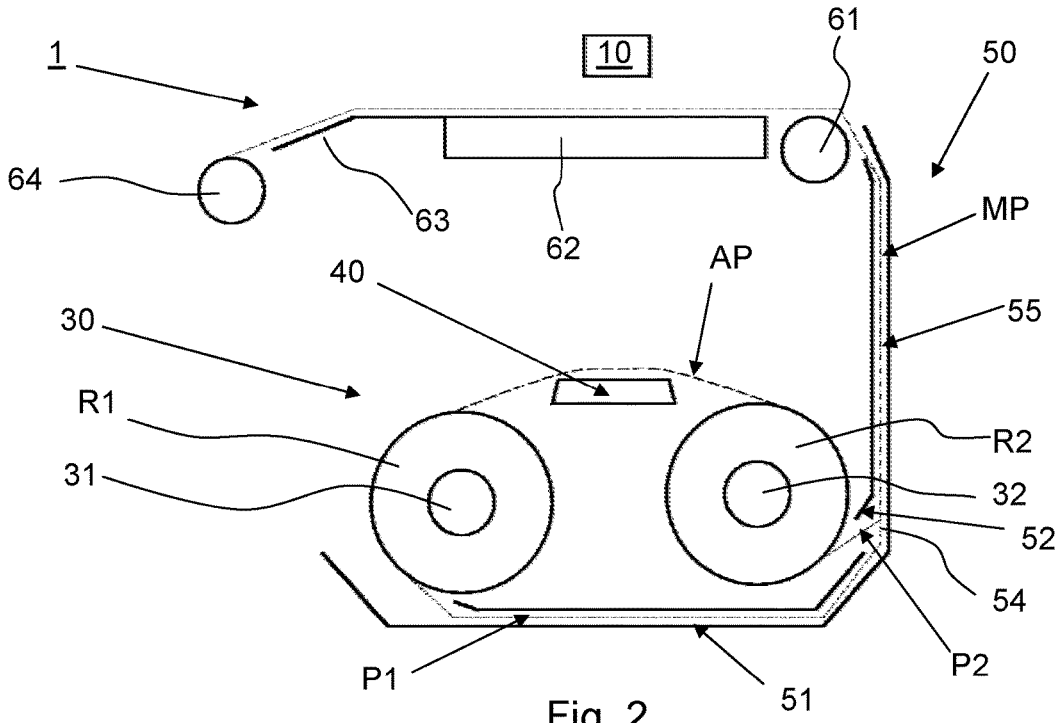
FIG. 2 is a schematic side view of a first embodiment of a printing system according to the present invention.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The inkjet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic, canvas, film or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material. A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

FIG. 2 illustrates schematically an image forming apparatus 1 or printing system 1 according to the present invention. Two bearing supports 31, 32 are provided in a loading bin or tray 30 for rotatably holding a respective media roll R1, R2. From each media roll R1, R2 a respective print transport path P1, P2 extends from the media roll R1, R2 to the inkjet printing assembly 10. In FIG. 1 the print transport paths P1, P2 in FIG. 2 join together at intersection 54, whereafter they continue as a single main print transport path MP which extends to the inkjet printing assembly 10. The print transport paths P1, P2 and the main print transport path MP are defined by a media guide assembly 50, comprising media guide plates or conduits 51, 52, 55 for forming the respective transport paths P1, P2, MP. The main print transport MP extends further along a transport roller 61 and over a media support surface 62 or platen 62 below the inkjet printing assembly 10. Downstream of the inkjet printing assembly 10 a medium 3, 4 may be guided via a guide support 63 to a take-up roller 64 for spooling the printed medium 3, 4 onto the take-up roller 64. The printing system 1 in FIG. 2 further comprises an attachment device 40 positioned along an attachment transport path AP extending from one of the media rolls R1, R2 supported on a respective bearing support 31, 32 to the other one of the media rolls R1, R2. The method according to the present invention and individual components of the printing system 1 are described with respect to FIGS. 3A-K and FIG. 6.

Figure 3A:
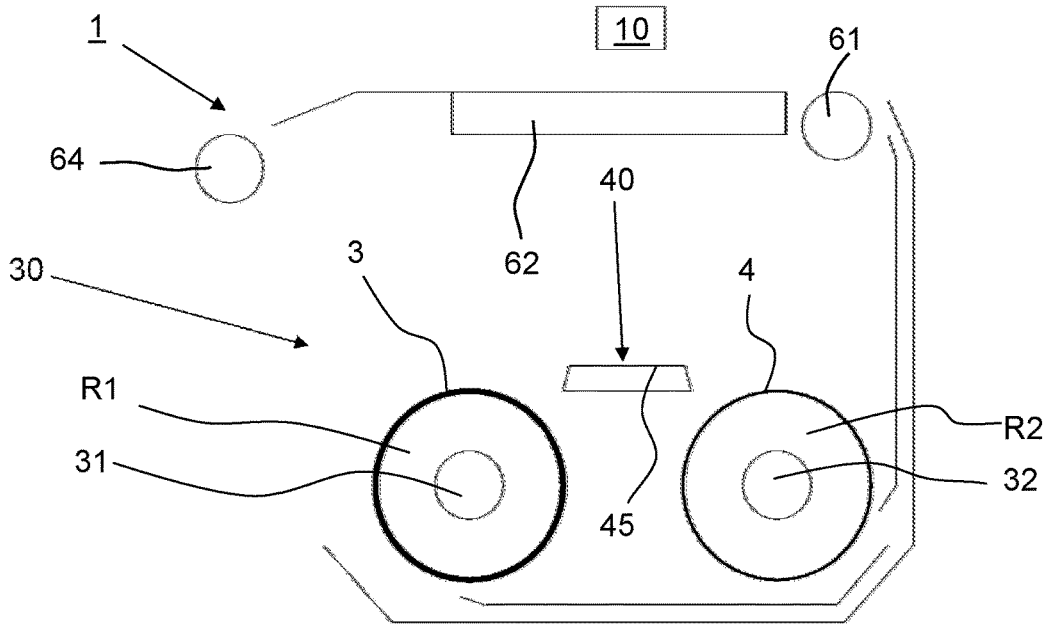
FIG. 3A-K are schematic side views of the printing system in FIG. 2 in various steps of the method according to the present invention.

In FIG. 3A two different print media 3, 4 are loaded onto the different media rolls R1, R2. The first media roll R1 on the first bearing support 31 comprises a first thicker medium 3, while the second media roll R2 on the second bearing support 32 holds a second relatively thin medium 4. The medium 3 on the first media roll R1 may also be cheaper (i.e. less expensive) than the medium 4 on the second media roll R2. It will be appreciated that the media rolls R1, R2 are interchangeable, such that the weaker medium may be placed on the left media roll R1 while the stiff medium is present on the right media roll R2. For clarity, the present invention is explained with referral to the situation shown in FIG. 3A. Preferably both media 3, 4 (and optionally additional media) are present in the loading tray 30 of the printing system 1 to accommodate different demands for a wide variety of print jobs and media. To increase production time, the print media 3, 4 are preferably fed into the printing system 1 by means of an automated web feeding system (indicated by 280, 282 in FIG. 5). Such a web feeding system 280, 282 comprises for example pinches 280, 282 to transport the media, motors and motor controllers to drive said pinches 282, 282 and media guides to guide the leading edge of a medium reliably to the print surface 62 at the inkjet printing assembly 10 without the assistance of an operator.

Figure 5:
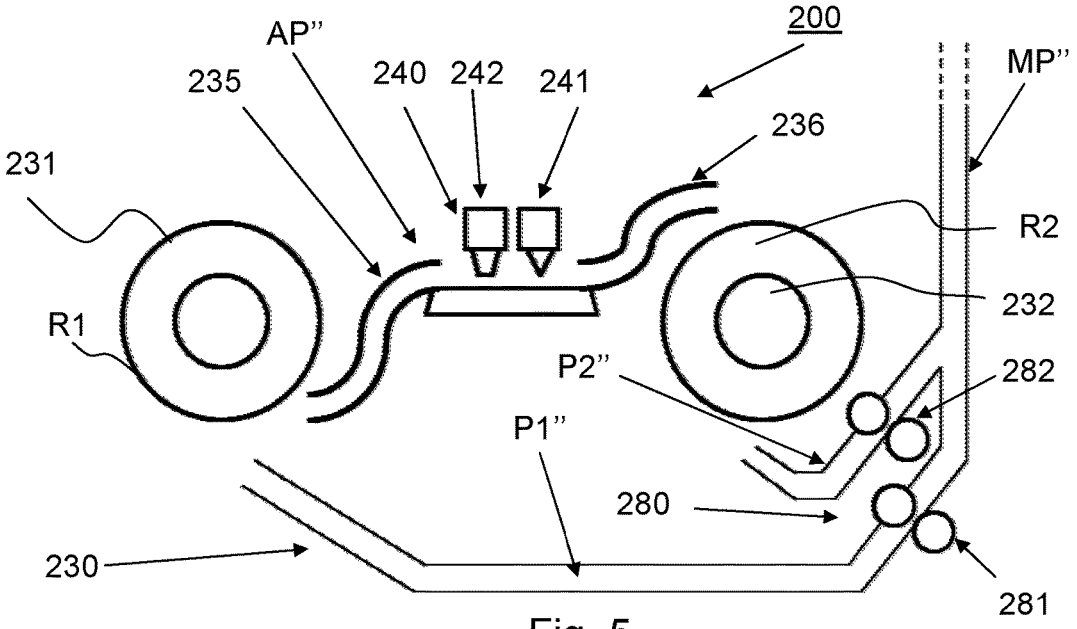
FIG. 5 is a schematic side view of a third embodiment of a printing system according to the present invention.

Some print media 4 may be too weak, too thin, too flexible, or otherwise unsuited to be handled by an automatic web feeding system 280, 282, as shown in FIG. 5. These weak media 4 cannot be pushed, e.g. over the print surface 62, without buckling and need to be pulled along a transport path P1, P2, MP, for example by means of a winder 64 or a pair of transport pinch rollers that applies a pulling force to said print medium 4. In practice these weak print media 4 are manually fed, which includes manually pulling the weak medium along the transport path P1, P2, MP and attaching the medium to the take up core of the winder 64 by an operator prior to printing. Production is stalled due to such manual feeding. It is noted that the winder 64 is used as an example. A pulling transport mechanism, such as a pinch roller or the winder 64, may be provided anywhere along the transport paths P1, P2, MP.

Figure 3B:
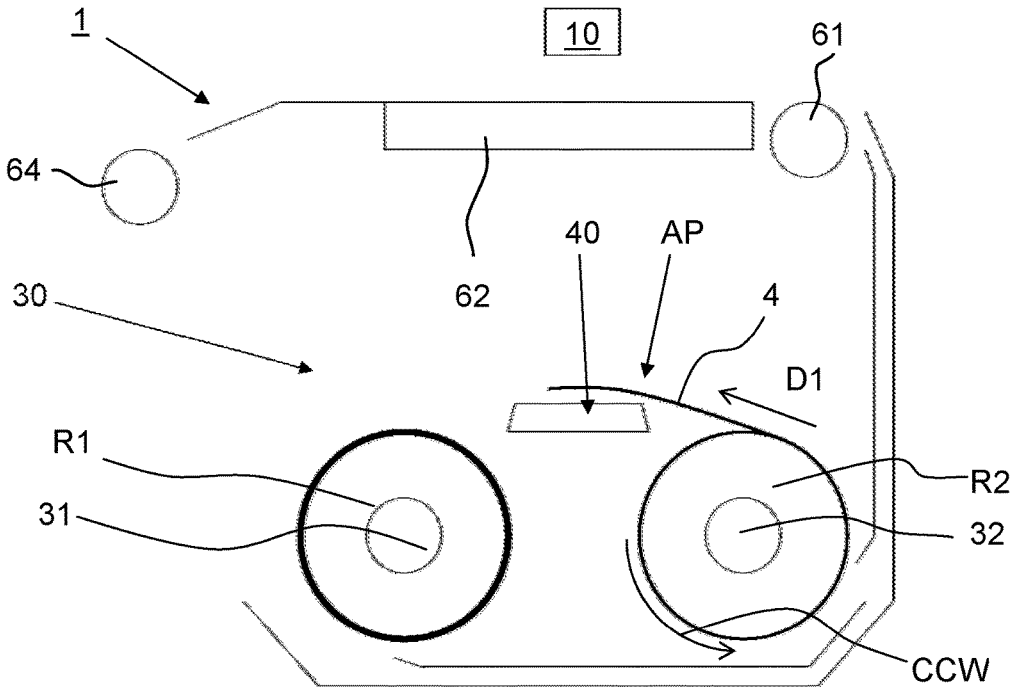
Figure 3C:
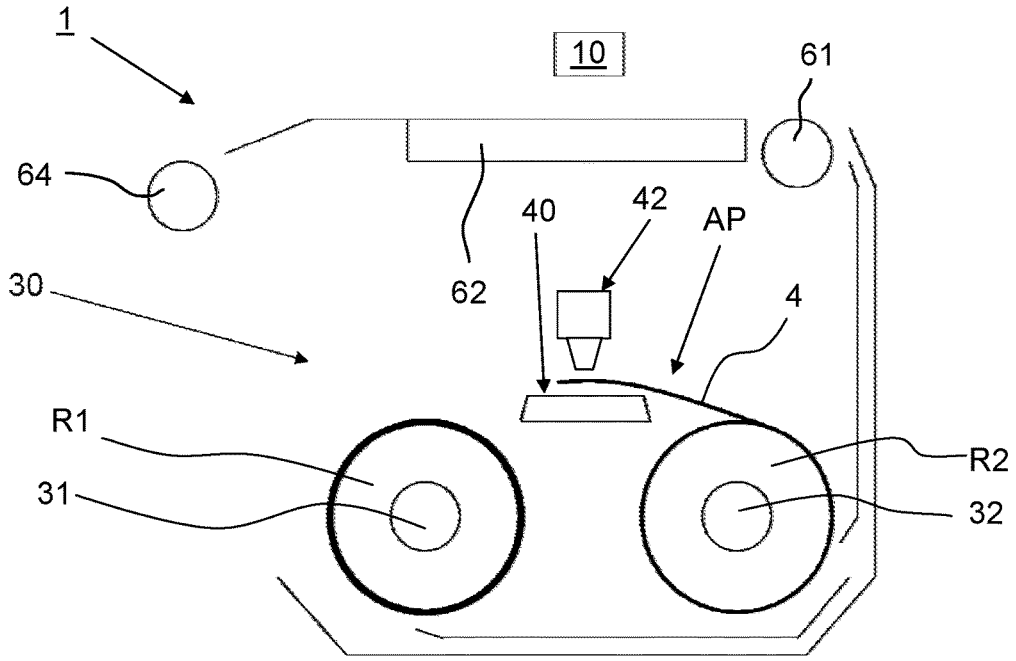
Figure 3D:
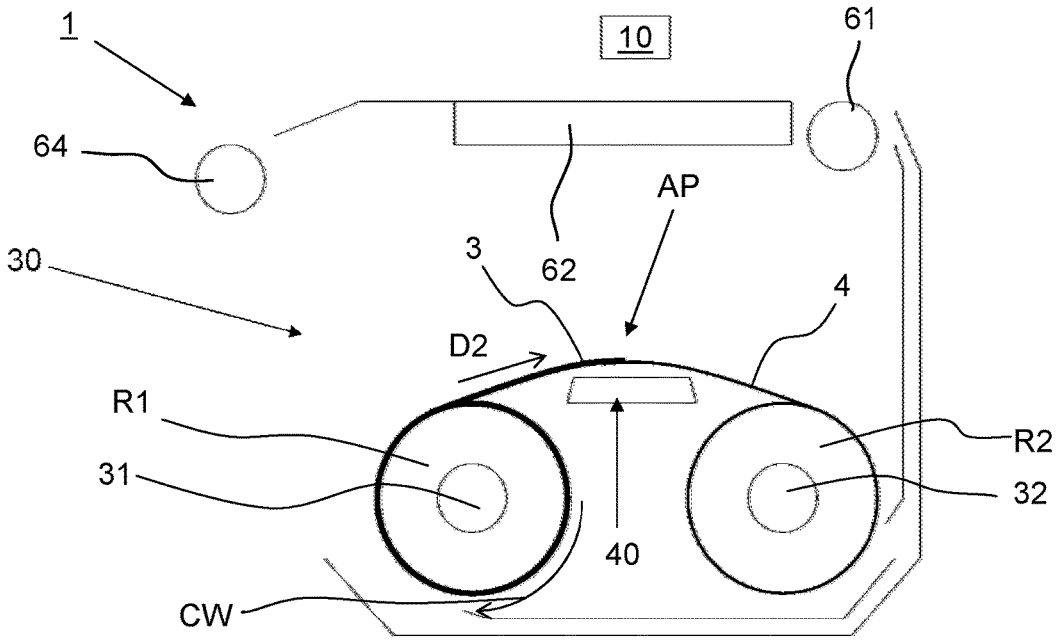

According to the present invention, a stronger or thicker print medium 3 (for example a medium 3 suitable for feeding by means of an automated web feeding system 280, 282) may be attached to the weaker medium 4 which weaker medium 4 itself is unsuitable for automatic web finding systems 280 of FIG. 5. The step i in FIG. 6 of transporting the media to one another is illustrated in FIG. 3B-D. In the example shown in FIG. 3B, the weaker or thinner medium 4 on the right media roll 32 is transported from its media roll R2 in a first transport direction D1 to the attachment device 40. The print medium 4, specifically its free end or leading edge region, moves along the attachment transport path AP, which extends between the media rolls R1, R2. Preferably the attachment device 40 is positioned between the bearing supports 31, 32, when viewed perpendicular to a plane defined by said bearing supports 31, 32 (from above in FIG. 3B). The attachment device 40 comprises an attachment surface 45, for example formed by a support plate 45, for supporting the print media 3, 4 during attachment. The attachment surface 45 extends parallel to a rotation axis of the media rolls R1, R2 and extends preferably over the width of a medium 3, 4 and/or a media roll R1, R2.

In FIG. 3B, the free end of the medium 4 is transported to the attachment device 40 by rotating the medium roll R2. The bearing support 32 comprises two support elements positioned at opposite ends of the media roll R2 for supporting the ends of the media roll R2. The bearing support 32 may comprise an actuator for rotating the media roll R2, for example a DC or step motor. The bearing support 31 may be configured in a similar manner. In FIG. 3B the media roll R2 is rotated in a first angular direction of the media roll R2 (counterclockwise CCW in FIG. 3B) to move the free end of the medium 4 in a first transport direction D1 until the free end of the medium 4 is positioned on the attachment surface 45 of the attachment device 40.

In the step ii, a leader section of the stiffer medium 3 is attached to the weaker medium 4. The media roll R1 is rotated clockwise CW to bring the leading edge of the medium 3 to the attachment device 40. When said media roll R1 were to be used as a print medium 3, it first needs to be flipped to correctly orient the media roll R1 with respect to the transport path P1. As shown in FIG. 3C, an adhesive such as glue or sticky tape is applied to the top surface of the medium 4 for performing step ii-a: attaching the media to one another. The adhesive may be applied manually by the operator. Alternatively, an adhesive applicator 42 may be provided to apply the adhesive to the medium 4, preferably over substantially the width of the medium 4 and near or adjacent its leading edge. The adhesive applicator 42 may comprise a page-wide applicator, such as a page-wide array of nozzles, or comprise an actuator arranged for moving the adhesive applicator 42 over the width of the medium 4, for example along a guide rail.

In FIG. 3D the free end of the stiffer print medium 3 is transported to the attachment device 40. To this end the media roll R1 is rotated in a first angular direction of the media roll R1, clockwise CW in FIG. 3D. The free end of the medium 3 is then positioned on top of the medium 4, such that the media 3, 4 are attached to one another by means of the adhesive. It will be appreciated that the adhesive may be applied to either or both of the media 3, 4 and that the media 3, 4 may be transported to the attachment device in any order or simultaneously. An operator may apply the first media roll R1, R2 as an attachment surface whereupon the print media 3, 4 are taped together.

Figure 3E:
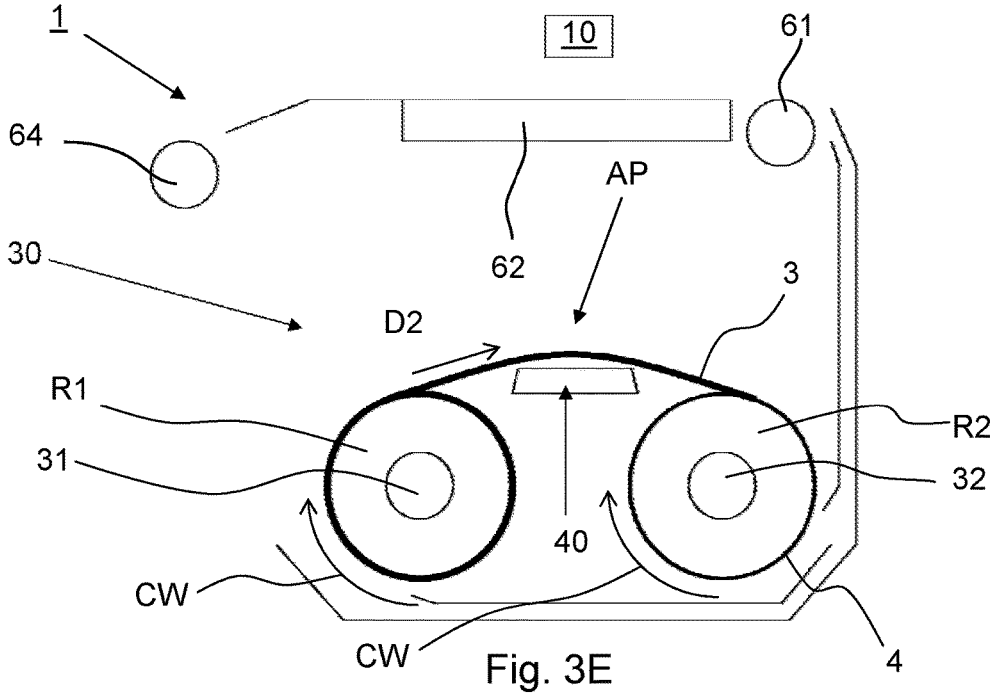
Figure 3F:
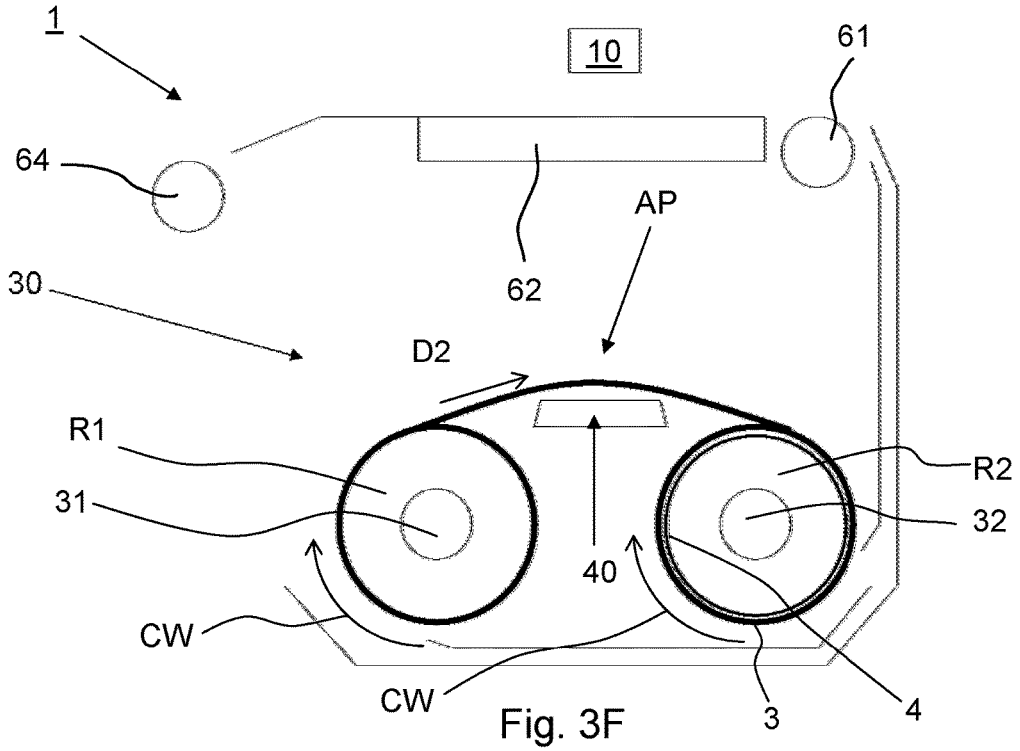

After attachment, a predefined length of the stronger medium 3 is spooled onto the media roll R2 of the weaker medium 4. This winding step ii-b is shown in FIGS. 3E and 3F. To this end, both print media 3, 4 move in the transport direction D2 at least partially along the attachment transport path AP. In the example given, the medium roll R1 is rotated in the same angular direction (clockwise CW) as in the step of transporting the stronger medium 3 to the attachment device 40 for attachment to the medium 3. When winding the leader section of the medium 3 onto the second media roll R2, the medium roller R2 rotates in an angular direction (clockwise CVV) opposite to the first angular direction (counter clockwise CCVV) of the medium roller R2 applied during the step of bringing the medium 4 to the attachment device 40 prior to attachment. The predefined length of the medium 3 which is spooled onto the medium roller R2 corresponds to a length of a transport path of the printing system 1, for example a transport path length from the medium roller R2 to the take-up roller 64 or the transport roller 61. Said length may further be a minimal length required for automatic web feeding.

Figure 3G:
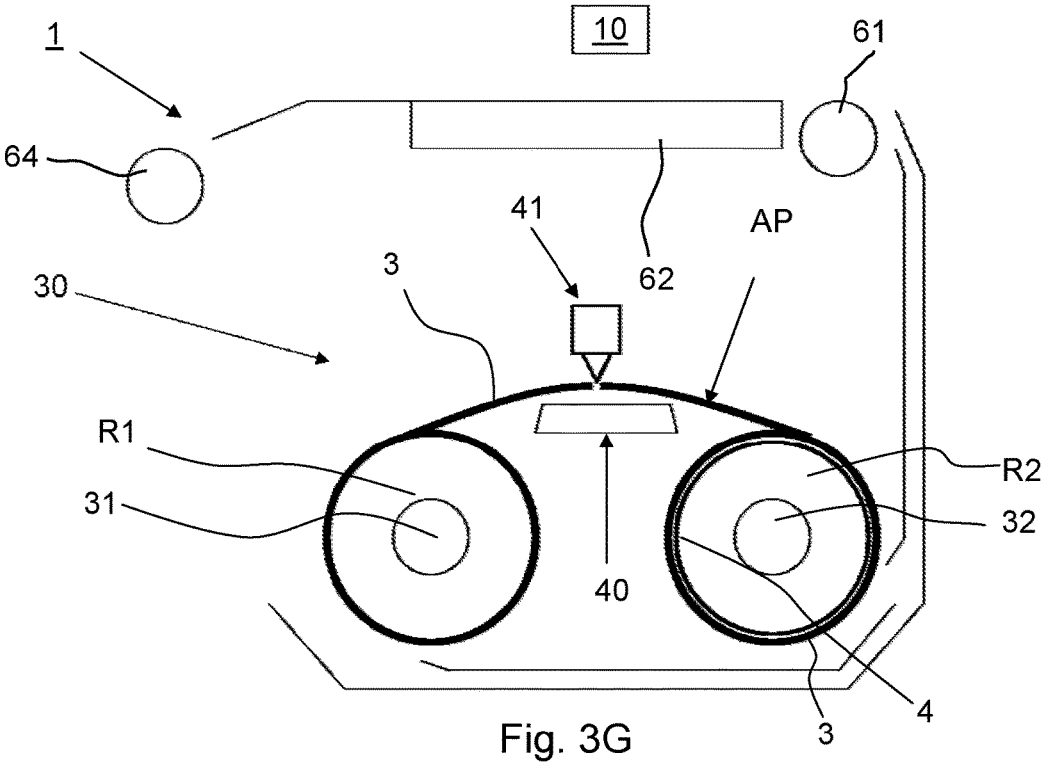

When a sufficient length of the first print medium 3 has passed along the attachment transport path AP, i.e. over the attachment device 40 in FIGS. 3D-F, onto the media roller R2, the first print medium 3 is cut in step iii-c, as shown in FIG. 3G. Cutting may be performed manually, but the printing system 1 preferably comprises a cutter 41 arranged for cutting a print medium 3, 4. The cutter 41 may be knife, preferably arranged for translating over the width direction of a print medium 3, 4. The cutter 41 and the adhesive applicator 42 may be provided together on a common carriage, guide rail and/or driven by a single actuator to reduce the number of components.

Figure 3H:
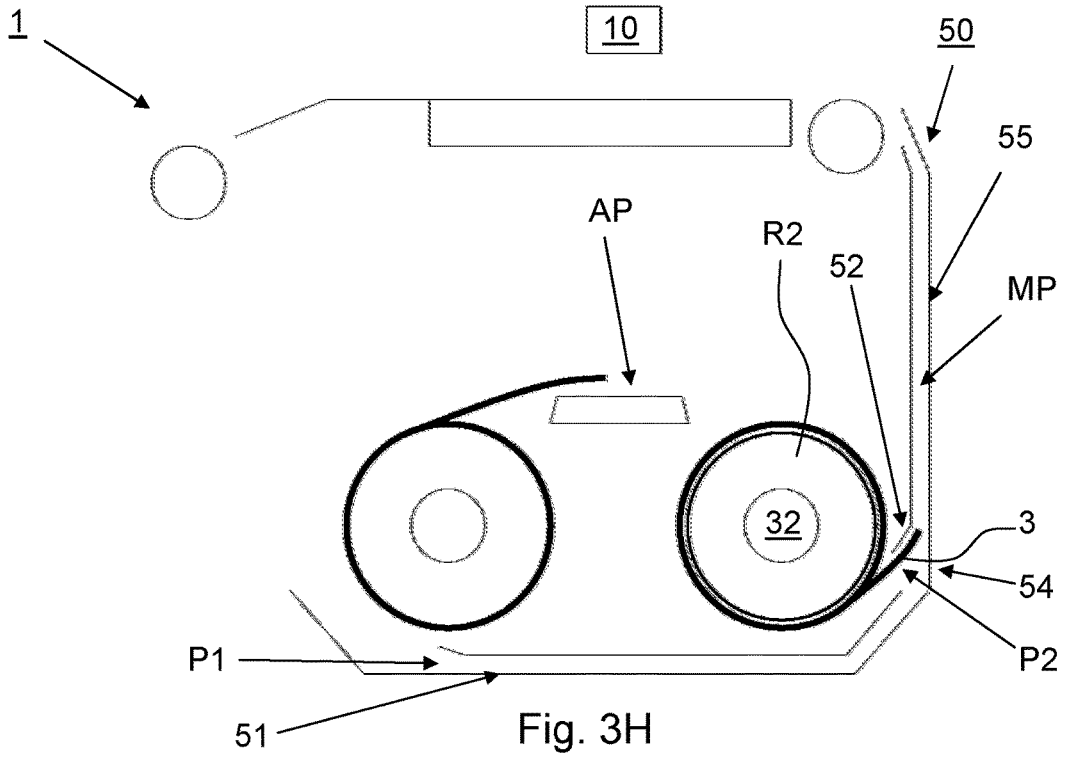
Figure 3I:
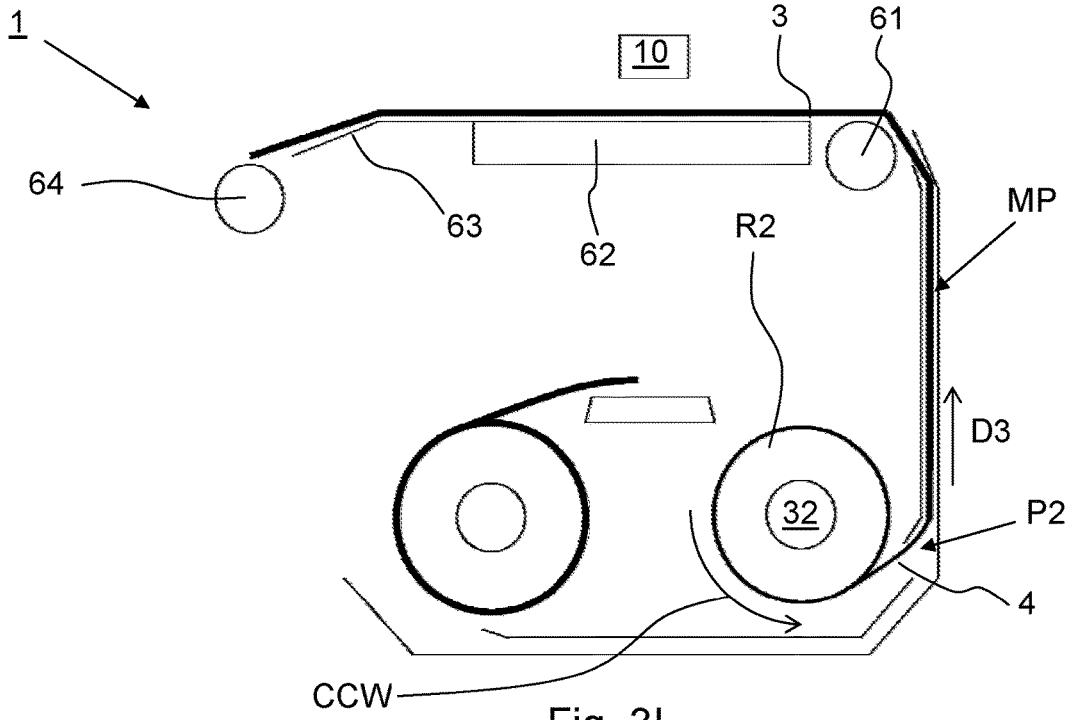

After cutting, the free end of the medium 3 is transported towards the inkjet printing assembly 10 in step iii, as indicated in FIGS. 3H-I. As shown in FIG. 2, the printing system 1 comprises a first and a second print transport path P1, P2 for bringing a print medium 3, 4 from its respective media roll R1, R2 to the inkjet printing assembly 10. The transport paths P1, P2, MP are defined by their respective guide elements 51, 52, 55, which may be in the form of guide surface, plates, conduits, rollers, pinches etc. In FIG. 3H, the print transport paths P1, P2 for the respective media 3, 4 join together into the main print transport path MP at the intersection 54.

Preferably, a web feeding system (280 in FIG. 5) is provided for feeding a medium 3, 4 along the transport path P1, P2, MP of the printing system to e.g. the take-up roller 64. Preferably, one or more pinch rollers (281 and 282 in FIG. 5) may be provided along a transport path P1, P2, MP for pushing and feeding the medium 3, 4 along the transport path P1, P2, MP. The media roll R2 is oriented, such that the leader section of the stiffer medium 3 is aligned with the second print transport path P2. The second print transport path P2 brings the free end of the stiffer medium 3 to the main transport path MP and to the inkjet printing assembly 10.

FIG. 3I illustrates the step iii-a wherein the stiffer medium 3 acts as a leader for feeding the weaker medium 4 through the printing system 1 to a pulling transport mechanism, which in this example is the winder 64, but may e.g. also be a pinch roller positioned upstream of the winder 64. Preferably, the medium 3 is suitable for feeding said medium 3 through the printing system 1 by means of a web feeding system (280 in FIG. 5). The medium 3 possesses for example sufficient thickness, strength and/or stiffness to be guided or pushed through along the transport path P1, P2, MP to the take-up roller 64 without tearing or buckling. Basically the cut-off section of the medium 3 forms a leader device for the weaker medium 4. As the leader section of the medium 3 is being transported along the transport path P1, P2, MP, the media roll R2 rotates and unspools first the remainder of the stiffer medium 3 and, following that, the weaker medium 4 attached to the leader section of the stiffer medium 3.

Figure 3J:
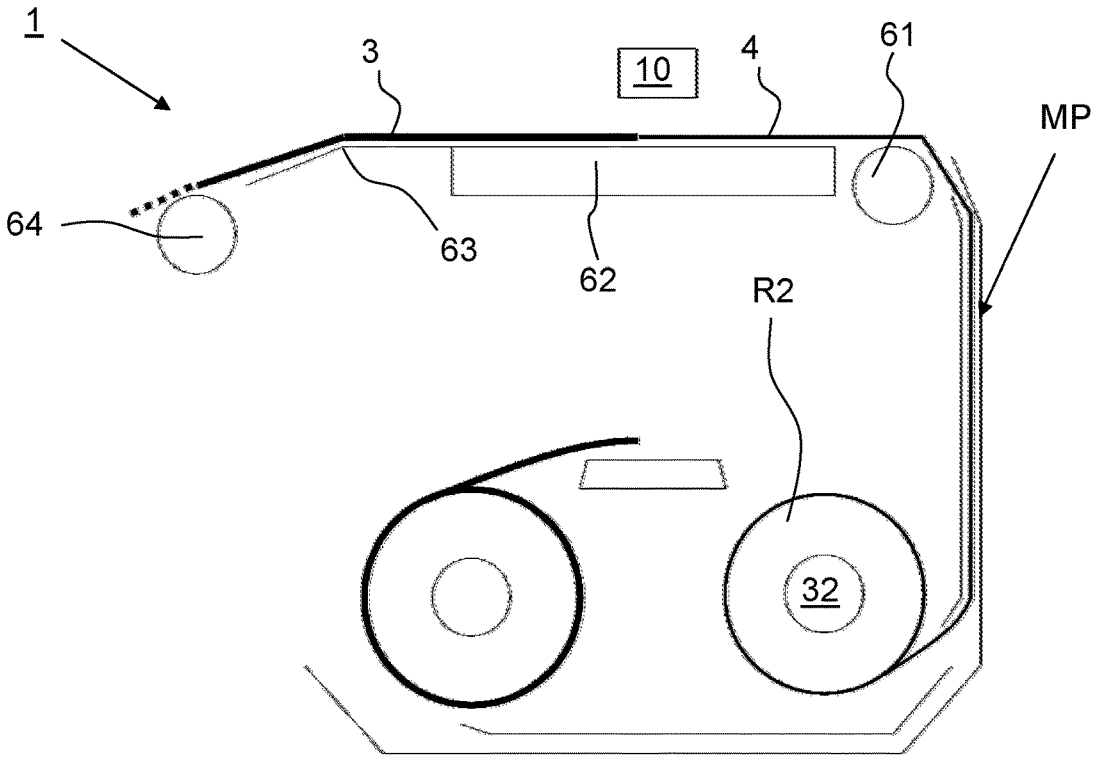
Figure 3K:
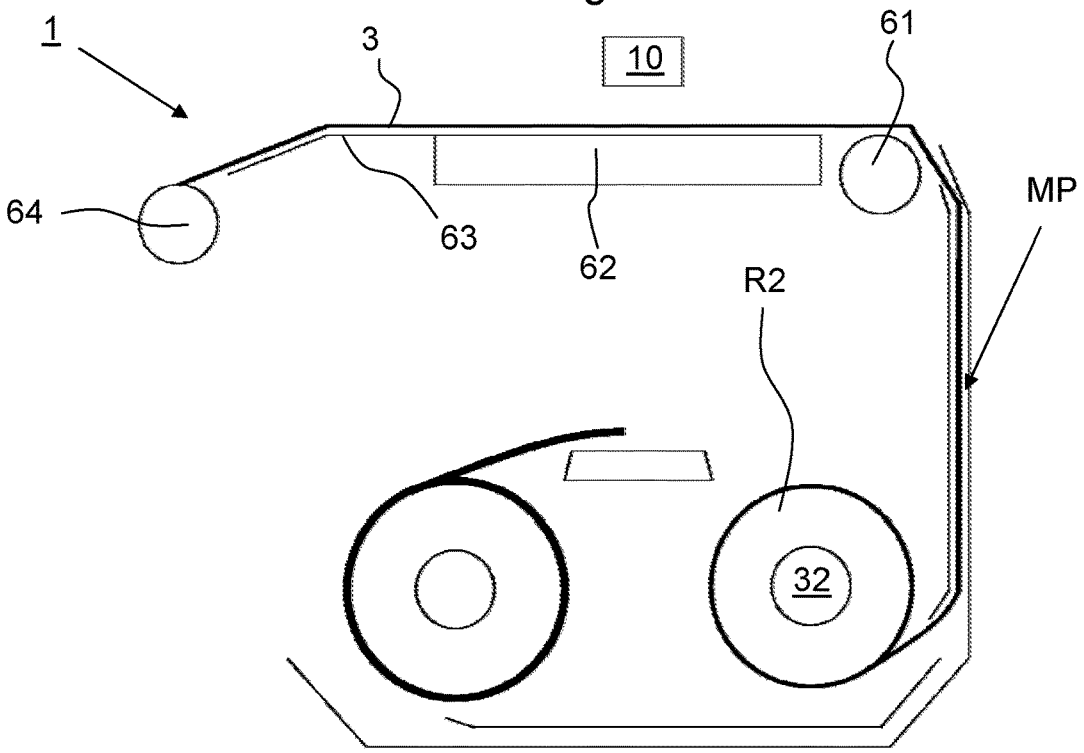

In FIG. 3I, the stiffer medium 3 is attached to the take-up roller 64, which then is arranged for pulling the remainder of the leader section of said medium 3, a shown in FIG. 3J, and the weaker medium 4 attached thereto through the printing system 1. By attaching the leader section of medium 3 to the take-up roller 64, the printing system 1 may commence printing as soon as the weaker medium 4 is positioned below the inkjet printing assembly 10. In this manner not only production time is reduced, but also the costs since no expensive medium 4 needs to be used for spanning the distance between the take-up roller 64 and the inkjet printing assembly 10. Alternatively, the leader section of the stiffer medium 3 may be removed from the weaker medium 4 and the free end of the weaker medium 4 may be attached to the take-up roller 64. The attachment device 40 may provide a releasable attachment between the media 3, 4, for example by means of a clamping engagement such as pair of magnetic clamping elements. During printing, the weaker medium 4 is wound onto the take-up roller 64, which take-up roller 64 is provided with an actuator for rotating the take-up roller 64. Thus, the situation illustrated in FIG. 3K is achieved, wherein the weaker medium 4 may be printed by means of the inkjet printing assembly 10 by pulling the medium 4 along the transport path MP by the pulling transport mechanism 64.

In the above example reference is made to a weaker and stronger media 3, 4. Weaker and stronger are defined in terms of the ability to push the medium 3, 4 along at least part of the transport path. At least of one of the media 3, 4 is unsuitable for being pushed along the transport path and generally requires attachment to a pulling transport mechanism 64 for transporting said medium 3, 4 along the transport path. This in turn is determined by the media properties, such as width, material, stiffness, etc., as well as the operating conditions of the printing system 1, such as temperature, humidity, configuration of the transport mechanism etc. It is further within the scope of the present invention to apply the same or similar media 3, 4 on both media rolls R1, R2 to create a suitable leader section by superpositioning said media 3, 4. Additionally, a relatively inexpensive medium 3 may be used for the leader section, as compared to a relatively more expensive medium 4 to be used for printing.

It will be appreciated that the present invention may further be applied for changing the to be printed side of a medium 3, 4 supplied from a media roll R1, R2. A medium 3, 4 is, for example, printed and wound onto a roll R1, R2, such that the printed surface faces radially outwards. The media roll R1, R2 is then returned to the loading bin for printing on the unprinted side of the medium 3, 4. The unprinted side of the medium 3, 4 will however be facing away from the print heads, as it was during the printing of the outward facing surface. The attachment transport path AP, AP', AP" allows the medium 3, 4 to be spooled onto a second media roll R2, such that the unprinted surface will be facing outwards. Thus a medium 3, 4 may be printed on a desired side of the medium regardless of whether said side is facing radially outwards or inwards on the media roll R, R2. This is particularly advantageous for media wherein both sides have been treated differently, for example, for a medium that supports on one side printing with Latex-based or solvent-based ink and on the other side printing with UV-treatable ink.

Figure 4:
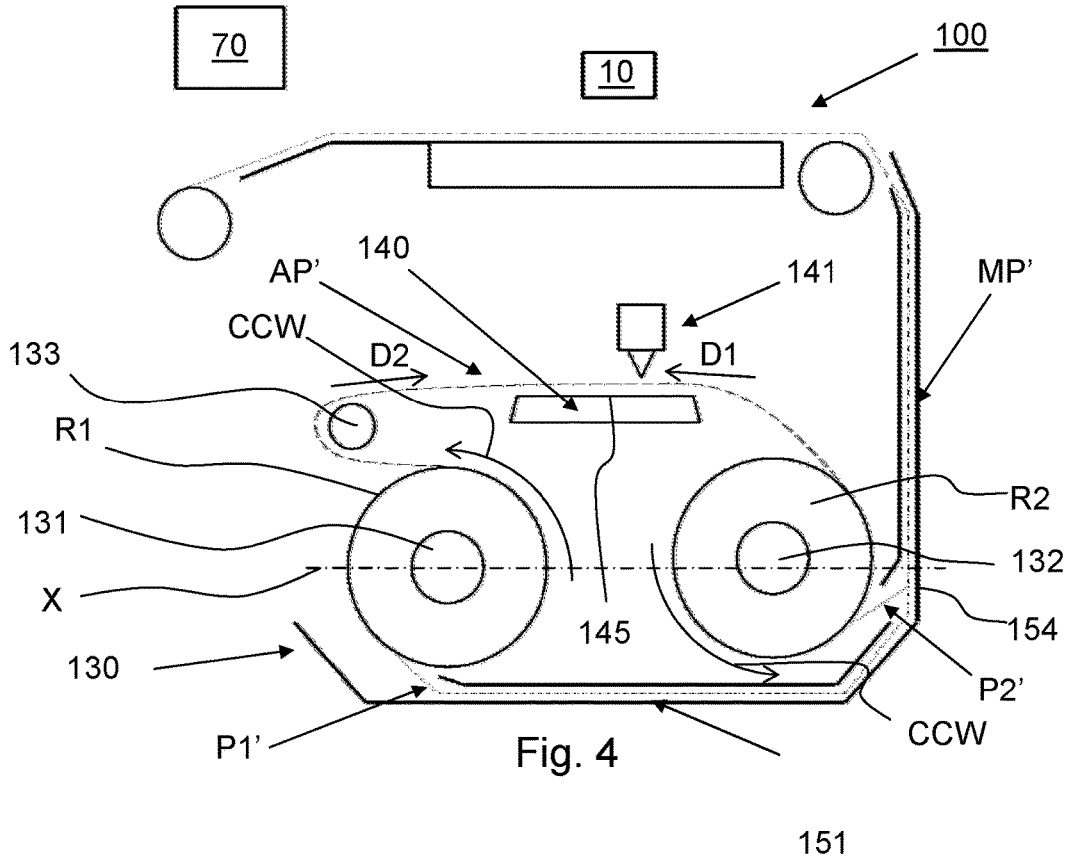
FIG. 4 is a schematic side view of a second embodiment of a printing system according to the present invention.

FIG. 4 shows schematically another embodiment of a printing system 100 according to the present invention. The printing system 100 is in several aspects similar to the printing system 1 in FIG. 2, so only the differences will be discussed. In FIG. 4, a guide unit 133 is provided along the attachment transport path AP' between the medium roller R1 and the attachment device 140 for inverting the direction D1, D2 of a medium 3, 4 on the attachment transport path AP'. The guide unit 133 allows the first media roll R1 to be rotated in the same angular direction CCW for moving the first medium 3 over the attachment transport path AP' to the second media roll R2 as over the print first transport path P1' to the inkjet printing assembly 10. The guide unit 133 may be a roller 133, guide plate, or conduit (235, 236 in FIG. 6). Since both the print transport path P1 and the attachment transport path AP' may be accessed while rotating the media roll R1 in the first angular direction CCW, the media roll R1 need not be taken out and flipped when its function changes between supplying a leader device and supplying print media, in contrast to the situation in FIG. 2. Thereby operator time and effort is reduced. The guide unit 133 or an additional guide unit may further be provided in a similar manner between the media roller R2 and the attachment device 140 or upstream of a print transport path P1', P2'.

FIG. 4 further illustrates the plane X defined by the bearing supports 131, 132. The plane X extends through the bearing supports 131, 132 such that in FIG. 4 a horizontal plane X is formed. The main transport path MP' extends vertically on the right side of the loading tray 130. The first transport path P1' is positioned below the plane X. Preferably, the second transport path P2' is substantially below the plane X as well. The attachment transport path MP' is positioned above the plane X to allow easy access thereto. The attachment transport path MP' in any of the embodiments is preferably remote or isolated from the first, second, and main transport paths P1', P2', MP'. To maintain a compact loading tray 130, the attachment transport path AP' does not connect directly to the main media transport MP'. When a leading edge is formed or present on the attachment transport path AP', said leading edge is wound onto one of the rolls R1, R2. Consequently, the roll R1, R2 with the leading edge is re-oriented or rotated to align the leading edge with one of the first and second transport paths P1', P2'. This allows the leading edge to be fed onto the main transport path MP'.

In FIG. 4, the attachment device 140 further comprises a cutter 141 arranged for cutting the media 3, 4. The cutter may a knife, preferably, a rotatable knife, arranged for slicing the media 3, 4 in the width direction B. Thereto, the knife may be provided on a guide rail extending over the attachment surface in the width direction B. A controller 70 may further be provided for controlling the cutter 141 and/or the actuators for the media rolls R1, R2.

FIG. 5 illustrates another embodiment of the printing system 200, wherein the attachment transport path AP" is defined by guide elements 235, 236. The first and second guide elements 235, 236 are arranged for transporting respectively the first and media 3,4 from the first and second media rolls R1, R2 to the attachment device 240. The attachment device 240 comprises the adhesive applicator 242 as well as the cutter 241.

FIG. 5 further illustrates the automatic web feeding system 280 provided along the first and second print transport paths P1", P2". The print transport paths P1", P2" each comprise one or more transport devices, such as pinch rollers 281, 282 arranged for engaging the media 3, 4 and pushing said media 3, 4 further along their respective print transport paths P1", P2". Additional pinch rollers may be provided along the print transport paths P1", P2" and/or the main transport path MP". The automatic web feeding system allows for hassle-free web feeding of weak media.

Figure 6:
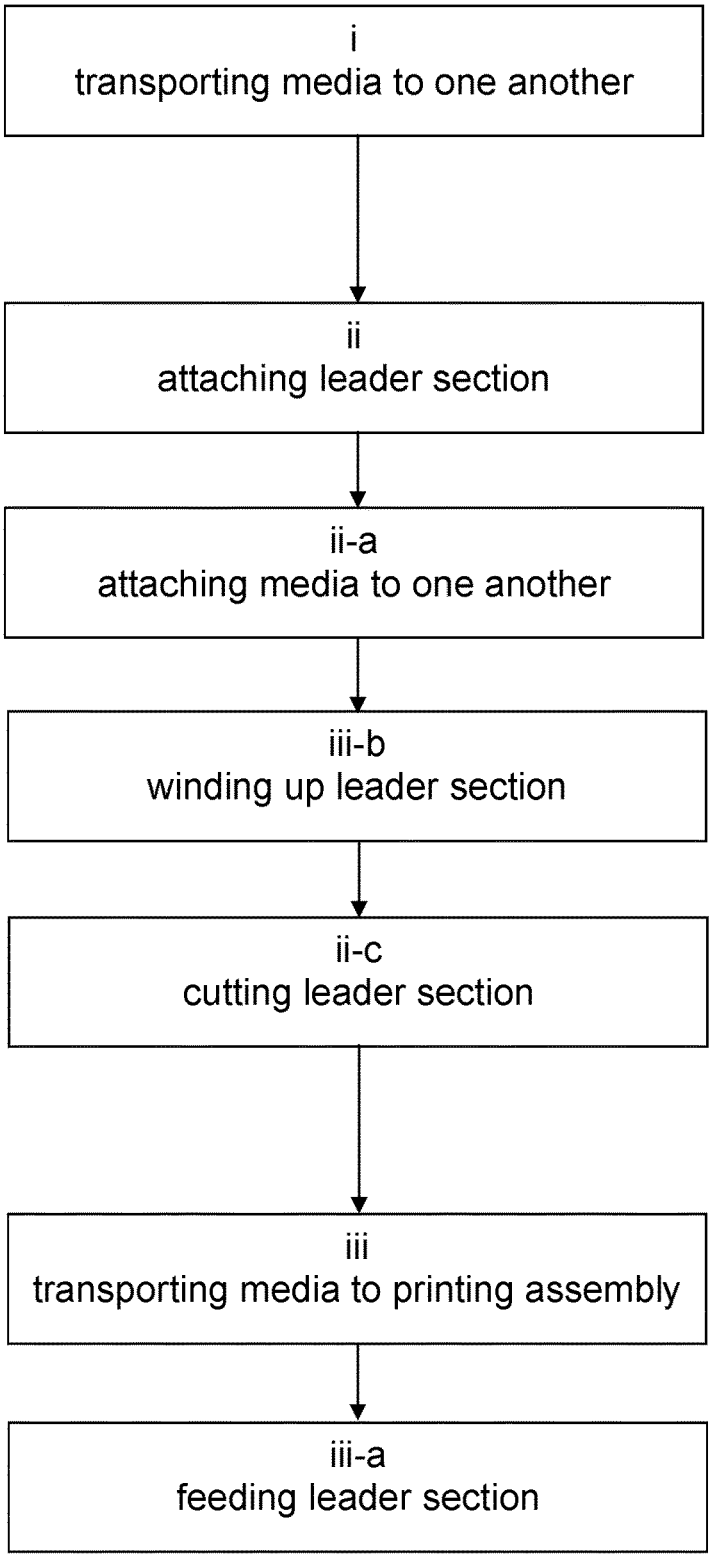
FIG. 6 is a diagram representing the steps of the method according to the present invention.

FIG. 6 illustrates a diagram showing various steps of the method according to the present invention as discussed with reference to FIGS. 3A-K.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A printing system, comprising:

a printing assembly for depositing an image on web-based media, positioned along a main transport path of the printing system;

a first bearing support arranged for rotatably supporting a first media roll of a first print medium;

a second bearing support arranged for rotatably supporting a second media roll of a second print medium, said first and second bearing supports being spaced apart from one another;

a first print transport path extending from the first bearing support for transporting the first print medium from the first media roll to the main transport path of the printing system;

a second print transport path extending from the second bearing support for transporting the second print medium from the second media roll to the main transport path of the printing system, wherein the first transport path bypasses the second transport path and the second media roll;

an attachment transport path extending between the first and the second bearing supports and spaced apart from the first transport path, and a web feeding system for transporting at least one of the first and second print media from a respective one of the first and second media rolls to the printing assembly.

2. The printing system according to claim 1, wherein the first transport path and the attachment transport path are positioned on opposite sides of one another with respect to a plane defined by the first and second bearing supports.

3. The printing system according to claim 1, wherein the attachment transport path is arranged for:

transporting the first print medium from the first media roll to the second media roll; and transporting the second print medium from the second media roll to the first media roll.

4. The printing system according to claim 1, wherein the first and the second print transport paths each connect to the main transport path at a transport path intersection spaced apart from the attachment transport path.

5. The printing system according to claim 1, further comprising an attachment device positionable along the attachment transport path for attaching the first and second print media to one another.

6. The printing system according to claim 5, wherein the attachment device comprises an attachment surface defining an attachment transport path section for transporting the first and second print media towards one another in opposite directions.

7. The printing system according to claim 5, wherein the attachment device comprises an adhesive applicator for applying an adhesive along substantially the width of one of the first and second print media.

8. The printing system according to claim 1, further comprising a loading tray comprising the first and second bearing supports, wherein the first transport path extends substantially along a bottom of the loading tray below the first and second bearing supports and the attachment transport path extends substantially above the first and second bearing supports.

9. The printing system according to claim 1, further comprising a roll actuator arranged for rotating the first media roll supported on the first bearing support:

in a forward direction for transporting the first print medium of the first media roll along the attachment transport path to the second media roll; and in a reverse direction for winding the second print medium from the second medium roll supported on the second bearing support onto the first media roll.

10. The print system according to claim 1, wherein the printing assembly is an inkjet printing assembly.

11. A method for feeding a web-based medium into a printing system, the method comprising the steps of:

transporting a first print medium from a first print medium roll and a second print medium from a second medium roll to one another via an attachment transport path;

attaching a leader section of a predefined length of the second print medium to the first print medium;

positioning the leader section attached to the second print medium with respect to one of a first and second transport path, which first and second transport paths are separate from the attachment transport path; and transporting the leader section attached to the first print medium via the one of the first and second transport path to an inkjet printing assembly of the printing system.

12. The method according to claim 11, further comprising the step of winding the leader section of the second print medium from the second media roll onto the first media roll via the attachment transport path.

13. The method according to claim 11, wherein the step of transporting the first and second print media comprises transporting the first print medium along an attachment transport path extending between the first media roll and an attachment position for attaching the first and second print media to one another;

the step of transporting the first and second print media further comprises transporting the second print medium along the attachment transport path, said attachment transport path further extending between the second media roll and the attachment position; and wherein the method further comprises the step of:

transporting the leader section of the predefined length of the second medium from the second media roll along the attachment transport path to the first media roll.

14. The method according to claim 11, wherein the step of attaching the first and second print media comprises attaching a leading edge region of the first print medium at a trailing edge region of the leader section of the second medium.

15. The method according to claim 11, wherein the step of transporting the leader section comprises feeding the leader section attached to the first print medium along a transport path of the printing system by means of a web feeding system.

* * * * *